US007946246B2

(12) United States Patent
Silverman

(10) Patent No.: US 7,946,246 B2
(45) Date of Patent: May 24, 2011

(54) HAND HELD MAGNETIC TEST PANEL HOLDER

(76) Inventor: Clifford J. Silverman, Green Oaks, IL (US)

( * ) Notice: Subject to any disclaimer, the term of this patent is extended or adjusted under 35 U.S.C. 154(b) by 942 days.

(21) Appl. No.: 11/895,390

(22) Filed: Aug. 24, 2007

(65) Prior Publication Data

US 2008/0048372 A1 Feb. 28, 2008

Related U.S. Application Data

(60) Provisional application No. 60/840,148, filed on Aug. 25, 2006.

(51) Int. Cl.
*B05C 13/02* (2006.01)

(52) U.S. Cl. ..... 118/500; 248/206.5; 211/DIG. 1; 269/8; 40/658; 40/661.01; 40/666; 40/600

(58) Field of Classification Search ..... 118/500; 269/8, 1, 2, 37; 248/206.5; D8/367, 373, D8/370, 371, 16, 71, 88, 107, 394, 354; D15/140; D6/400; 294/65.5; 40/658, 661.01, 666, 40/600; 211/DIG. 1; 52/DIG. 4
See application file for complete search history.

(56) References Cited

U.S. PATENT DOCUMENTS

| | | | | | |
|---|---|---|---|---|---|
| 1,371,484 | A | * | 3/1921 | Howard | 73/40 |
| D301,012 | S | * | 5/1989 | Possemato | D8/373 |
| 4,826,059 | A | * | 5/1989 | Bosch et al. | 224/183 |
| 4,934,119 | A | * | 6/1990 | Ybarra | 52/238.1 |
| 5,037,051 | A | * | 8/1991 | Moriello | 248/215 |
| 5,301,822 | A | * | 4/1994 | Coleman et al. | 211/70.6 |
| 6,152,416 | A | * | 11/2000 | Jacob | 248/441.1 |

* cited by examiner

*Primary Examiner* — Laura Edwards
(74) *Attorney, Agent, or Firm* — Justin Lampel

(57) ABSTRACT

A hand held magnetic test panel holder that will attach metal or paper test panels magnetically, and will magnetically attach to a metal wall or surface. Its main body is formed to provide a handle and an extension to provide space to hold a test panel at a distance to paint a test panel without the paint coming in contact with the user's hand. This hand held magnetic test panel holder holds a metal clip board with its magnet, which in turn will hold a paper test panel. The user will paint the test panel with a paint spraying device with one hand, and hold the hand held magnetic test panel holder with the other hand. When not in use, the device will magnetically attach to a metal wall for storage and when paint is in the drying process.

8 Claims, 4 Drawing Sheets

HAND HELD MAGNETIC TEST PANEL HOLDER

CROSS-REFERENCE TO RELATED APPLICATIONS

U.S. 60/840,148 filed Aug. 25, 2006

FEDERALLY SPONSORED RESEARCH

None.

SEQUENCE LISTING

None.

BACKGROUND OF THE INVENTION

1. Field of the Invention

This invention relates to a hand held magnetic test panel holder that will improve the process of producing individual test panels used for color matching, tinting and color reference.

2. Prior Art

The inventor discovered that test panels are often held directly by the user's hand to be painted, which poses a risk to the painter due to the skin contact with various types of paints. Another method of painting test panels is to tape them to a stir stick and then hold the stir stick by hand, creating a distance away from the sprayed paint. This method is better than holding the test panel directly, although the process of taping the test panel to a stir stick is more time consuming and can add material costs over time. When spray painting of a test panel is complete, wet test panels are usually set on a table or other horizontal surface to dry. This exposes the wet paint to dirt and contamination, creating an undesired appearance to the paint. My invention, the hand held magnetic test panel holder, will provide multiple advantages and improvements for painting test panels. The key advantages of this invention are that it provides an easy and safer way to hold test panels, it speeds up the process of creating a test panel, it reduces material costs associated with producing test panels, and it holds the test panel in an isolated location while the paint is drying. The invention holds a metal test panel via a magnet at the top section. The test panel holder will also hold panels made of paper (or other non metal substrates), by its metal clip board, which is magnetically attached to the magnet at the top section. To reduce the user's risk of coming in contact with the paint being sprayed, the user holds the test panel holder at the bottom section, at its handle. The length of the holder's main body distances the test panel at the upper area from the handle, where the painter's hand is, to avoid contact with the sprayed paint. For paint drying, and for storage, the test panel holder is placed on a metal wall or other metal surface by its mounting magnets. When the paint is drying on the test panel, the entire holder is set out of the way of the immediate work area on the wall so the paint can dry without disturbance or contamination. The entire process of creating a test panel is improved because of the ease of quick attachment of the test panel to its holder, whether it is a metal panel held directly by the holding magnet, or if it is a paper panel, held on the clipboard, which is held to the holder.

U.S. Pat. No. 4,934,119 to Yharra shows a movable wall assembly using magnets to secure wall partitions together. This magnetic attachment is intended for holding partitions, whereas the test panel holder's magnets are intended to attach a test panel on one side and attach itself to the wall at the other end. Storage of the test panel holder is to be placed anywhere on a wall and not to be connected to other test panel holders, such as the movable wall partitions as described by Yharra. Although both inventions utilize magnets to hold objects in place, they differ greatly in scope and detail.

U.S. Pat. No. 5,037,051 to Domenico describes a mountable hanger for rear view mirrors using magnetic attachment for a novelty article to be hung. Although this is also a magnetic hanger with an automotive application, it is in no relation to the test panel holder since it will not assist in holding a test panel for spraying, nor will it hang to the wall for paint drying.

U.S. Pat. No. 4,826,059 to Bosch and Dyer show a portable and foldable magnetic tool holder. Although this could hold a test panel due to its magnets, it would not be suitable for spraying test panels since the backing of the holder would be covered in paint and the entire device would not hold magnetically to the wall.

U.S. Pat. No. 5,301,822 to Coleman and Scalise show a magnetic tool holder that mounts on a wall. This is intended to hang tools. Although a test panel could be attached to this device, and the device could be attached to a wall for paint drying and regular storage, the device does not have a handle for holding and does not include any bends for extending beyond and away from the wall.

Various other designs for holding tools or test panels do exist, but with limitations in comparison to my invention. None of the above items described offer the ability to hold a test panel at a distance for the painter to paint safely and to hang on the wall for drying and storage. None of the prior art specify any type of test panel holding clipboard or other aspects in close relation similar to the hand held magnetic test panel holder. Magnetic attachment of a test panel and the combination of magnetic attachment to a wall further differentiate the invention, along with a handle connected with the main body. The added leverage due the magnet positioning is also a key innovation first cited with the hand held magnetic test panel holder.

Reference list of prior art cited:

U.S. Pat. No. 4,934,119 to Yharra (1989)
U.S. Pat. No. 5,037,051 to Domenico (1990)
U.S. Pat. No. 4,826,059 to Bosch and Dyer (1987)
U.S. Pat. No. 5,301,822 to Coleman and Scalise (1993)

BACKGROUND OF THE INVENTION—OBJECTS AND ADVANTAGES

Accordingly, besides the objects and advantages of the hand held magnetic test panel holder that will simplify the test panel making process in my above patent, several other significant objects and advantages of the present invention are:

a) To provide a means to hold a test panel while painting it
b) To provide a method to hold a test panel at a safe distance without exposing one's hand to the paint being sprayed
c) To hold various types of test panels such as metal, paper or plastic
d) Will offer easy placement and storage by attaching to a metal surface, preferably a spray booth wall, tool box or other vertical wall
e) To magnetically hold on a surface to be color matched such as the surface of a car, truck or other metal object being matched or painted
f) To hang securely to a metal wall with its magnetic strength, design and positioning of the holding magnets.

SUMMARY

This invention, the magnetic test panel holder for spraying and checking paint colors, will provide an easy way to perform the function of painting test panels. The device will hold the metal test panel with its holding magnet, and will hold paper panels by its metal clip board, in which the clip board is then attached to the holding magnet. This invention will enable the painter to attach test panels quickly and firmly, without the use of tape, stir sticks or other items to hold a test panel. The test panel holder will attach to a metal wall with its magnets, providing easy and safe storage while the paint is drying. More specifically, the following features are most unique of this magnetic test panel holder:

1. The test panel holder attaches magnetically to the wall for quick and easy placement while paint is drying
2. The spacing and positioning of the mounting magnets provide added stability and holding power to the wall
3. The shape of the test panel consists of a handle for firm gripping of the device
4. The extended bend distances the test panel away from the wall to avoid scratching or smudging of the freshly applied paint
5. The removable test panel is positioned toward the top of the device to keep far away from the handle, and the user's hand, to avoid exposing the user to the sprayed paint
6. The test panel holding magnet will hold a metal test panel directly to the test panel holder
7. The metal clip board holds paper, plastic or other non-metal test panels to the test panel holder
8. The holding clip, on the clip board, will hold paper test panels to the clip board and provide easy attachment and removal of the paper test panel

DRAWINGS

REFERENCE NUMERALS

Figure 1:
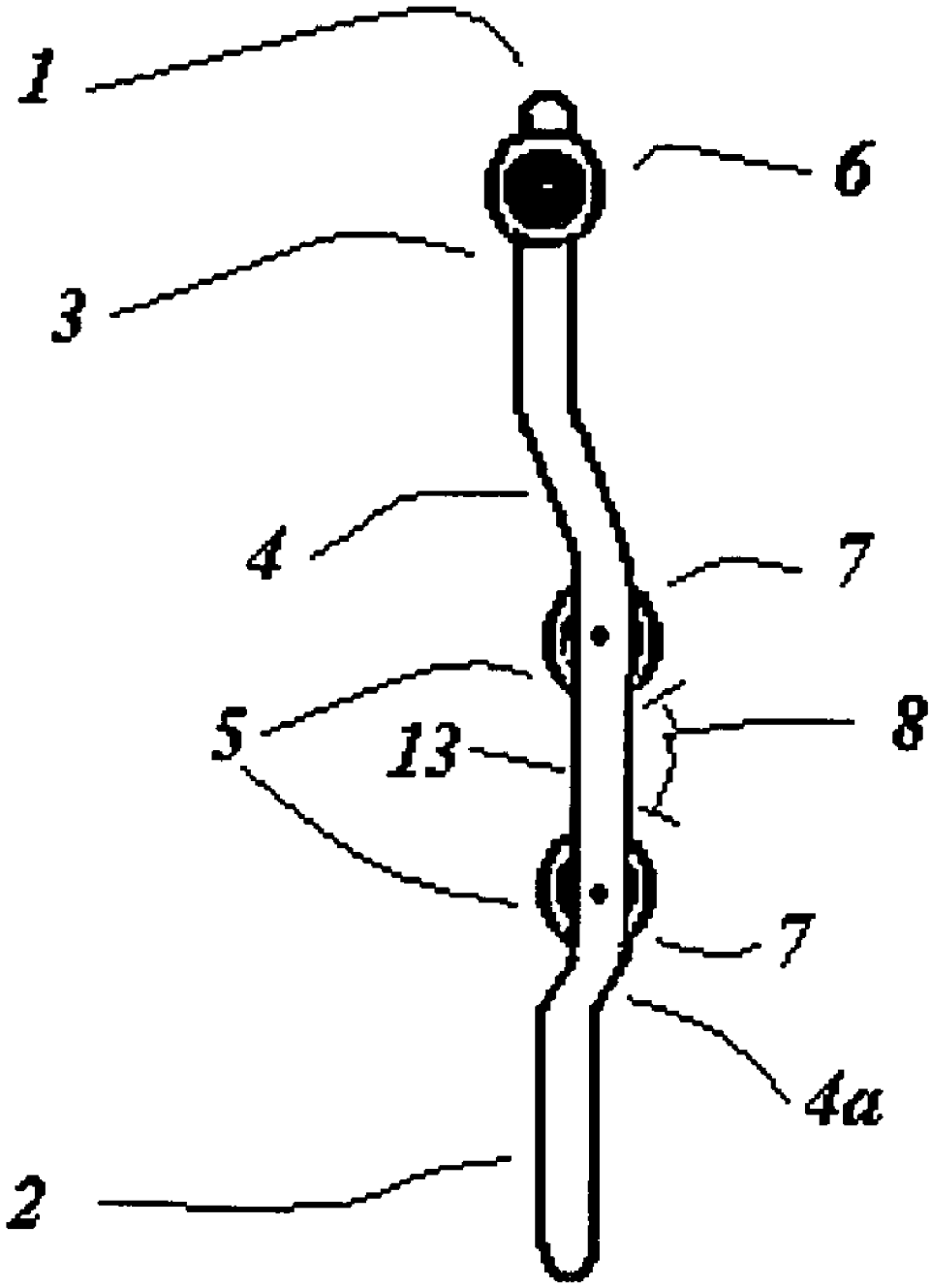
FIG. 1 shows the overall device with the magnets attached

1. Main body
2. Handle section
3. Test Panel Holding Section
4. Extension from wall surface section upper
4*a* Extension from wall surface section lower
5. Mounting magnets
6. Test panel holding magnet
7. Extra leverage positioning
8. spacing distance at the outer edges
9. Metal Clip board
10. Test panel holding clip
11. Metal test panel
12. Paper test panel
13. Center section

DETAILED DESCRIPTION

FIG. 1 shows an overall view of the device and its bends with its magnets attached. The Main Body 1 is constructed of 16 gauge steel, although it can be made of other thicknesses. It can also be made of various types of metals or plastics. Said main body 1 has four bends that define its shape and operation. Handle section 2 is comprised of two bends, the extension from the wall surface lower section 4*a* starts away from the center section 13 and the second bend curves back parallel with said center 13 section to create an ergonomically useful and comfortable holding shape as said handle section 2. Extension from wall surface section upper 4 distances the test panel holding section 3 away from said center section 13 to allow for freshly painted test panels 11 or 12, to be distanced from making contact with the wall and to allow for air to flow around the wet paint.

Figure 2:
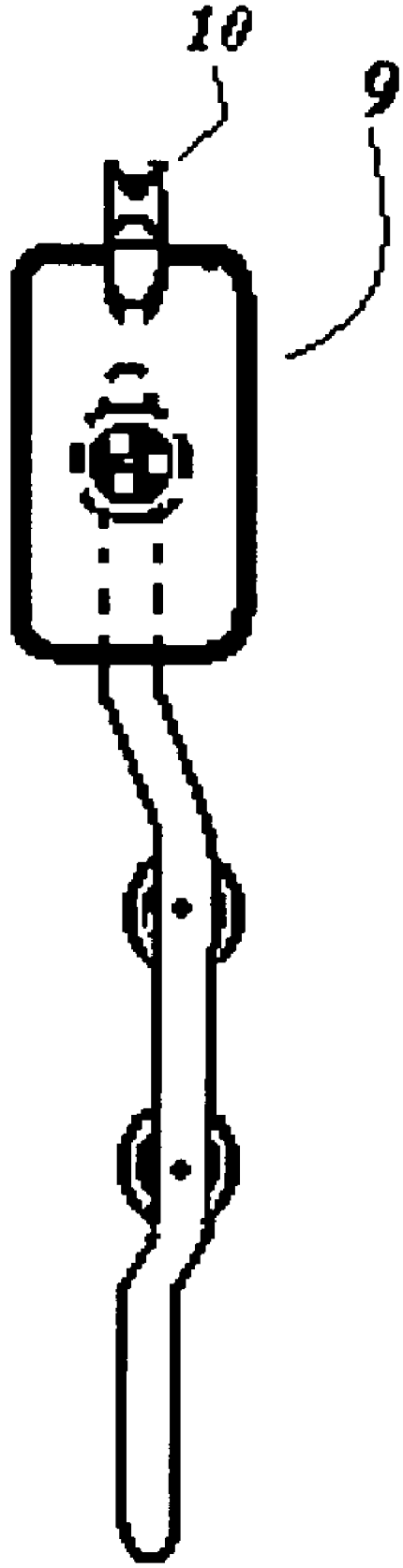
FIG. 2 shows the device holding the metal clip board
Figure 3:
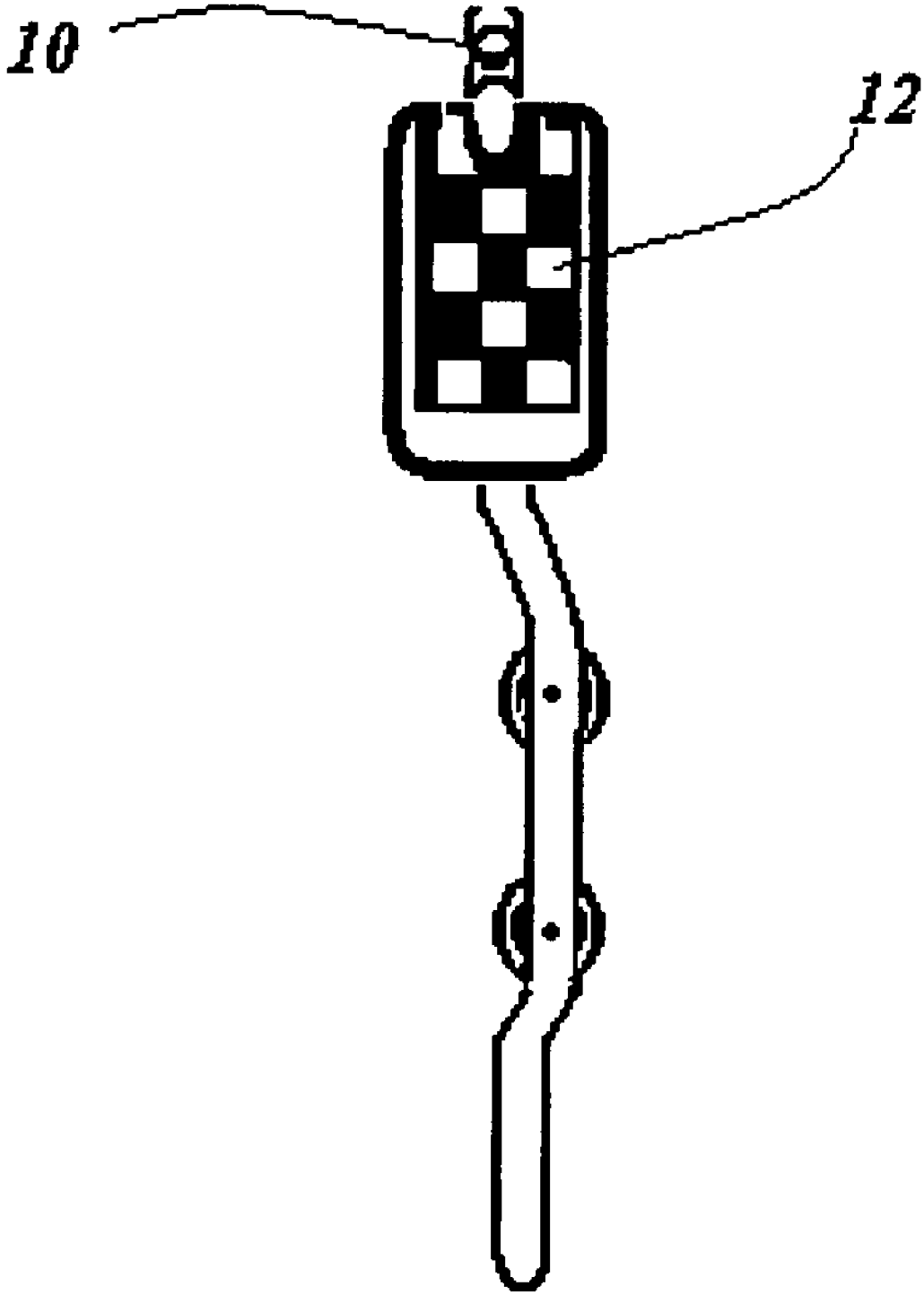
FIG. 3 shows the device holding the clip board with a paper test panel in place
Figure 4:
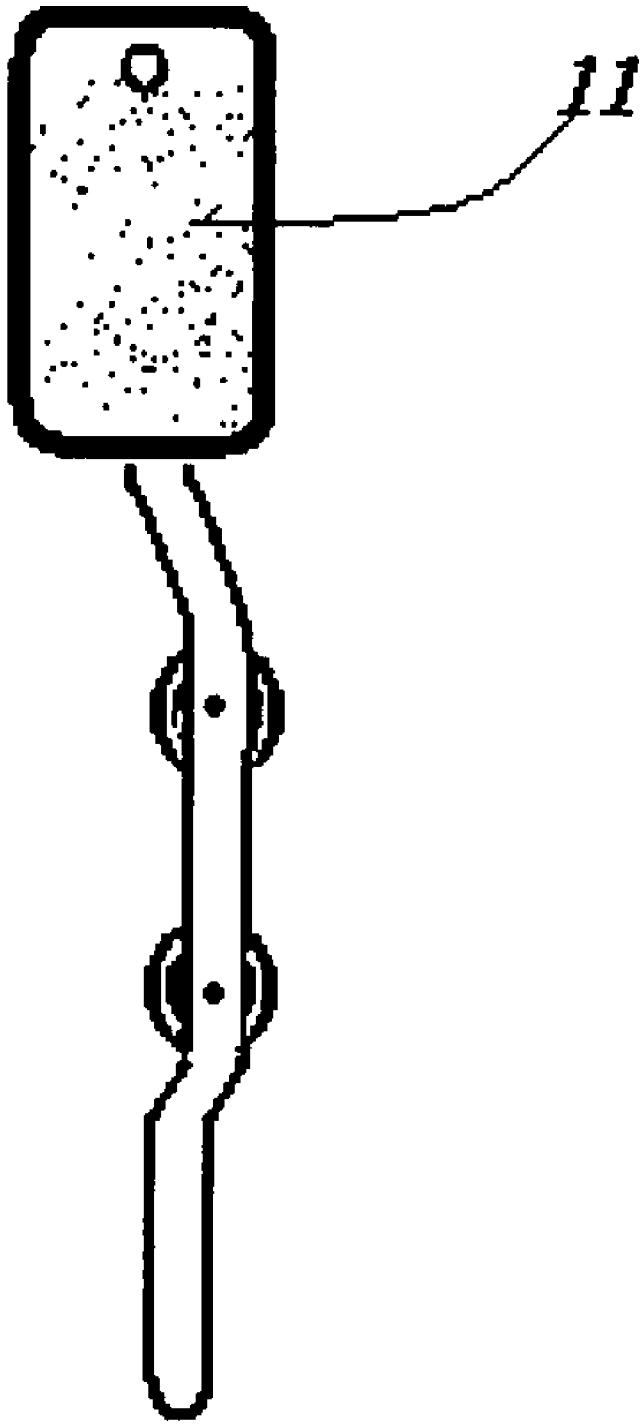
FIG. 4 shows the device holding a metal test panel attached directly to the magnet

FIG. 1 shows the position of said mounting magnets 5, as they are held in place to said center section 13 by rivets or fasteners. Added holding strength to a metal surface is due to the furthest spacing distance possible at the outer edges 8 of said center section 13. Test panel holding magnet 6 holds the option of either a metal test panel 11, shown in FIG. 4, or the metal clip board 9, as shown in FIG. 2. In the event paper test panel 12 is to be used, said paper test panel 12, shown in FIG. 3 is inserted at test panel holding clip 10 found at the upper section of said metal clip board 9. Said metal clip board 9 is connected to said test panel holding magnet 6 at said test panel holding section 3.

Operation:

Main Body 1 is held by the user at said handle section 2 in one hand. The user sprays paint with the other hand, applying paint with spray application equipment to said metal test panel 11 or said paper test panel 12. Once finished spraying a coat of paint, the user can either continue to hold the device until the next coat of paint is to be applied, or is dry, or the user can place the device on a metal wall surface by its said mounting magnets 5. The power of said mounting magnets 5, and the added holding power due to distance and positioning of magnets 8, and extra leverage positioning 7, will enable the entire device and its contents of said paper test panel 12 and said metal clip board 9, or said metal test panel 11, to hold securely to the wall surface.

Said paper test panel 12 is slipped between said metal clip board 9 and said test panel holding clip 10, shown in FIG. 3. Said metal clip board 9 is attached to said test panel holding magnet 6. To remove said paper test panel 12, it is simply pulled out of this position by releasing it from said holding clip 10. Said metal test panel 11 is attached directly to said test panel holding magnet 6, shown in FIG. 4, and removed once spraying is finished, or paint is dried.

CONCLUSION, RAMIFICATIONS, AND SCOPE

Accordingly, the reader will see that a hand held magnetic test panel holder of the type described will improve the process of painting test panels for a painter.

- It permits the user to paint a test panel with reduced risk of coming in contact with the paint overspray
- It allows the user to paint metal test panels, paper test panels and other panel materials with ease due to its magnetic holding type and its clipboard
- It attaches to metal walls magnetically for easy storage
- It is ergonomically shaped to provide a handle at the lower end
- The positioning and distance of the mounting magnets add to the best possible leverage ability for the magnetic power available by the magnets Although the description above contains many specificities these should not be construed as limiting the scope of the invention but as merely providing illustrations of some of the presently preferred embodiments of this invention. For example, the overall bracket can have other shapes, lengths and sizes provided the bracket will hold to the wall and hold the test panels intended. The handle section can have different shapes, coatings or attachments.

Thus the scope of the invention should be determined by the appended claims and their legal equivalents, rather than by the examples given.

I claim a hand held magnetic test panel holder bracket comprising:

1. A hand-held magnetic test panel holder bracket comprising:

a main body consisting of four bends with a flat center section parallel to a lower terminal section and parallel to an upper terminal section wherein the flat center section has a magnet and wherein both upper and lower terminal sections are located on the same axis and are extended away from said center section wherein the lower section forms a handle and a test panel holding area at said upper section, each of the lower and upper sections being raised and extended from said center section but parallel with said center section and a test panel holder including a magnet in the upper section.

2. A hand held magnetic test panel holder bracket in accordance with claim 1 wherein the magnet faces upward at a top of a front side of said center section.

3. A hand held magnetic test panel holder bracket in accordance with claim 1 further comprising a plurality of attached magnets facing downward on a rear side of said center section attached in a position as far apart as can be attached toward edges of a rising bend at an end of said center section with a portion of a magnet body extending beyond a first bend upward at a lower section and a portion of said magnet body extending beyond the first bend of said upper section.

4. A hand held magnetic test panel holder bracket in accordance with claim 1 wherein said magnet at said upper section is constructed and arranged to hold a metal panel of the type used for spraying paint for color match testing.

5. A hand held magnetic test panel holder bracket in accordance with claim 1 further comprising a plurality of magnets attached to said center section constructed and arranged to hang a weight of the main body and a metal test panel attached to a metal surface.

6. A hand held magnetic test panel holder bracket in accordance with claim 1 further comprising a section of sheet metal comprising an unattached, removable holding clip that can be placed upon said upper section.

7. A hand-held magnetic test panel holder bracket comprising:

a main body consisting of four bends with a flat center section parallel to a lower section and parallel to an upper section wherein the flat center section has a magnet and wherein both upper and lower sections are raised at a slight height by a connecting section sloping upward and bent parallel over that bring the upper and lower sections extended away from, but parallel in direction with said center section to create a handle at said lower section and a test panel holding area at said upper section, each of the lower and upper sections being raised and extended from said center section but parallel with said center section;

a plurality of attached magnets facing downward on a rear side of said center section attached in a position as far apart as can be attached toward edges of a rising bend at an end of said center section with a portion of a magnet body extending beyond a first bend upward at a lower section and a portion of said magnet body extending beyond the first bend of said upper section; and a test panel holder including a magnet in the upper section.

8. A hand-held magnetic test panel holder bracket comprising:

a main body consisting of four bends with a flat center section parallel to a lower section and parallel to an upper section wherein the flat center section has a magnet and wherein both upper and lower sections are raised at a slight height by a connecting section sloping upward and bent parallel over that bring the upper and lower sections extended away from, but parallel in direction with said center section to create a handle at said lower section and a test panel holding area at said upper section, each of the lower and upper sections being raised and extended from said center section but parallel with said center section; and a section of sheet metal comprising an unattached, removable holding clip that can be placed upon said upper section.

* * * * *